United States Patent [19]

Tjushevsky et al.

[11] 4,412,438

[45] Nov. 1, 1983

[54] PIPE BENDING MACHINE

[75] Inventors: Vladimir M. Tjushevsky; Vladimir E. Ermakov; Fikrat S. O. Seidaliev; Gennady A. Sjusin; Igor I. Dobkin; Jury V. Krasovsky, all of Moscow, U.S.S.R.

[73] Assignee: Gosudarstvenny Nauchnoissledovatelsky, Proektny I Konstruktorsky Institut Splavov I Obrabotki Tsvetnykh Metallov "Giprotsvetmetobrabotka", U.S.S.R.

[21] Appl. No.: 286,686

[22] Filed: Jul. 24, 1981

[51] Int. Cl.[3] ..... B21D 7/08; B21D 7/14; B21F 3/02

[52] U.S. Cl. ..... 72/10; 72/21; 72/135

[58] Field of Search ..... 72/10, 14, 21, 30, 135, 72/173, 175; 242/82

[56] References Cited

U.S. PATENT DOCUMENTS

| | | | |
|---|---|---|---|
| 3,270,979 | 9/1966 | Whitacre | 242/82 |
| 3,407,639 | 10/1968 | Kehne | 72/135 |
| 3,824,820 | 7/1974 | Jeuken et al. | 72/10 |
| 3,859,830 | 1/1975 | Jeuken et al. | 72/10 |

FOREIGN PATENT DOCUMENTS

| | | | |
|---|---|---|---|
| 444450 | 3/1936 | United Kingdom | 72/10 |
| 471942 | 9/1975 | U.S.S.R. | 72/21 |
| 607628 | 5/1978 | U.S.S.R. | 72/10 |

*Primary Examiner*—Ervin M. Combs
*Attorney, Agent, or Firm*—Steinberg & Raskin

[57] ABSTRACT

A pipe bending machine has a pipe feed rate setter. A bending unit has a bending roller and a drive for displacing the bending roller in the plane of bending, and a follow-up roller. The follow-up roller is arranged for engagement with the pipe after the pipe has been subjected to the action of the bending roller and is secured to one arm of a two-arm lever having a pivot axis which intersects the center line of the incoming pipe. The other arm of the lever carries a movable contact of the bending roller drive. The contact alternately engages two stationary contacts of the drive.

7 Claims, 6 Drawing Figures

PIPE BENDING MACHINE

FIELD OF THE INVENTION

The present invention relates to the production of pipes and rods. More particularly, the invention relates to a pipe bending machine for bending and coiling pipes and rods into a package. The machine may be utilized as an output unit of a tube-welding or tube-rolling mill.

BACKGROUND OF THE INVENTION

The prior art machines for pipe bending now in use are intended either for obtaining pipe coils with convolutions of uniform diameter or for processing short length pipes. Lacking in these machines are means for laying the pipe convolutions into a coil and maintaining a preselected diameter of the convolutions when the length of pipe being bent varies in mechanical property or in cross-section. As a result, the coils produced have convolutions of non-uniform diameter and are not sufficiently compact, while a subsequent use thereof may cause the convolutions to intertwine, which in turn results in pipe breakage, as well as reduction in the rate of processing and in the efficiency of such pipe finishing machines as drawbenches, coiled pipe surfacing apparatus, etc.

A known draw bending apparatus comprises a mandrel holder with a mandrel, a driven drum receiving a pipe being bent, and pipe feed and pipe coil carrying means (cf., e.g., G. V. Rosov "Proisvodstvo trub—Pipe Production" Moscow, the Metallurgia Publishers, 1974, p. 416). However, pipe coils produced by this apparatus have convolutions of non-uniform diameter the value of which, depending on the force applied during draw bending, cross-section and pipe wall thickness, or mechanical properties of the pipe, may be in excess of, or less than, the diameter of the coil carrying drum. The resultant coil lacks compactness, while the pipe convolutions making up the coil tend to intertwine, thereby hampering subsequent coil processing, which is especially the case with pipes of substantial length and small cross-sectional diameter.

Also known is a wire coiler disclosed in U.S. Pat. No. 3,270,979, granted Sept. 6, 1966. The machine comprises a bending assembly including a bending capstain or block, a system of guide and pressure rollers, an electric drive and a coil carrying means. The same disadvantages as those referred to in the foregoing apparatus are generally inherent in this machine. Furthermore, the machine is not provided with a coil laying means to produce tightly packed bundles or packages without the pipe coils being intertwined.

Another known machine for roll bending pipes of short length comprises a carrying frame, a pipe bending assembly and a drive means (cf. A. I. Galperin "Machiny i oborudovanie dlya gnutia trub—Machines and Equipment for Bending Pipes," the Mashinostroenie Publishers, 1967, pp. 34 and 48).

A further prior art pipe bending machine incorporates a pipe feed rate setting means, a bending assembly in the form of a plurality of rollers disposed on a frame, one of the rollers being a bending roller, and a drive for imparting movement to the bending roller in the plane of pipe bending from a form block by means of a follow-up roller and a guide (cf. A. I. Galperin "Mashiny i oborudovanie dlya gnutia trub—Machines and Equipment for Bending Pipes," the Mashinostroenie Publishers, Moscow, 1967, p. 49). The form block of this machine sets the bending roller in a certain position in the plane of bending, although this set position fails to guarantee a preselected radius of the bend when the mechanical properties of the pipe or cross-section thereof vary.

Also, the aforedescribed machine permits the processing of pipes of limited length determined by the length of the form block. Therefore, the machine cannot be used for bending pipes of greater length.

SUMMARY OF THE INVENTION

The principal object of the invention is to provide a pipe bending machine for coiling pipes of large length into bundles with a preselected diameter of pipe coil irrespective of the varying mechanical properties of the pipe along its length.

An object of the invention is to provide a pipe bending machine for coiling pipes of cross-sectional diameter varying along the length thereof into bundles.

Another object of the invention is to provide a pipe bending machine for making bundles or coils having a preselected diameter of convolutions and packed to prevent intertwining and to minimize coil bundle sizes.

Still another object of the invention is to provide a pipe bending machine for coiling into bundles pipes of any length and pipes having cross-sectional diameters varying along the length thereof regardless of varying mechanical properties.

Yet another object of the invention is to provide a pipe bending machine for producing pipe bundles having preselected coil diameters and compactly placed to prevent intertwining of the convolutions during subsequent use of the bundles.

These objects are attained by a pipe bending machine comprising a pipe feed rate setting means. A pipe bending unit has a bending roller with a drive for effecting displacement of the bending roller in the plane of bending. A follow-up roller is coupled to the drive of the bending roller. A pipe coil carrier is provided. In accordance with the invention, the follow-up roller cooperates with the pipe after the pipe has been subjected to the action of the bending roller and is secured to one arm of a two-arm lever having a pivot axis which intersects the center line of the incoming pipe. The other arm of the two-arm lever carries a movable contact of the drive of the bending roller adapted to alternately engage one of two stationary contacts of said drive.

Preferably, the movable contact of the drive of the bending roller is movable along the arm length of the two-arm lever.

This movable contact may be provided with means for imparting reciprocating motion thereto along the arm length of the lever within the limits determined by preselected inner and outer diameters of the pipe coil. Alternatively, the stationary contacts of the drive of the bending roller may be arranged on a platform reciprocable relative to the movable contact within limits determined by preselected inner and outer diameters of the pipe coil.

The coil carrier is preferably reciprocable in a plane substantially parallel to the plane of pipe bending towards and away from the bending roller and in synchronism therewith.

In order to obtain compact coil bundles, the pipe bending machine may be provided with an overhanging guide structure positioned substantially in the plane of pipe bending and having a length at least equal to the maximum coil diameter. The guide structure accommodates idle rollers to support and permit free movement of the pipe convolution towards the coil carrier.

BRIEF DESCRIPTION OF THE DRAWINGS

For a fuller understanding of the invention, reference is had to the following description, taken in connection with the accompanying drawings, in which.

DESCRIPTION OF PREFERRED EMBODIMENTS

Figure 1:
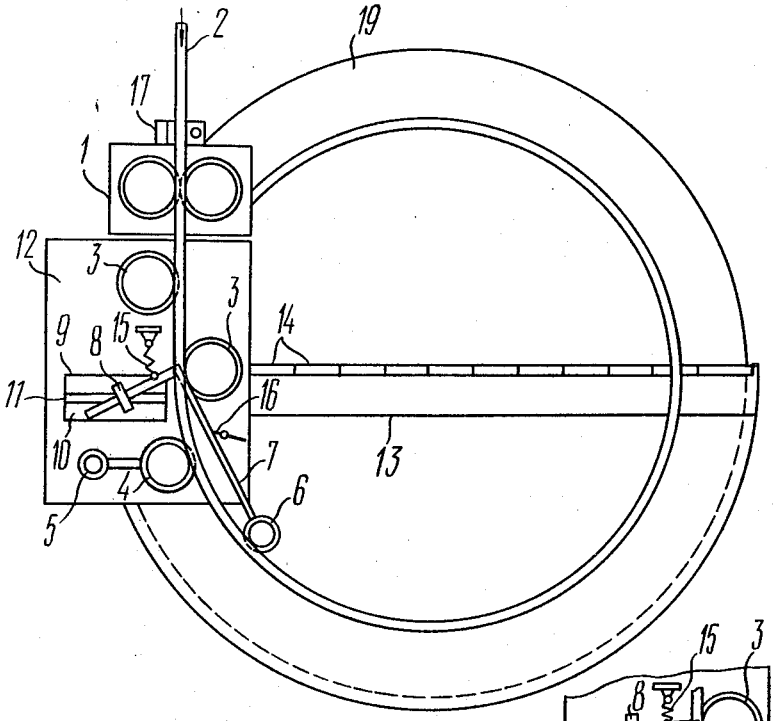
FIG. 1 is a top plan view of an embodiment of the pipe bending machine of the invention.
Figure 2:
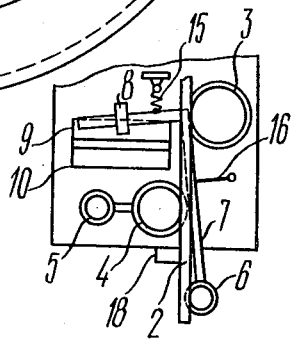
FIG. 2 is a top plan view of the follow-up system of the embodiment of FIG. 1 during the initial stage of its operation.
Figure 3:
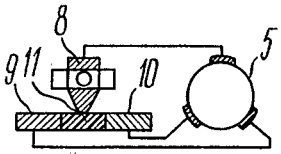
FIG. 3 is a sectional elevation of the contacts of an embodiment of the drive unit for displacing the bending roller, also showing the drive control circuitry.
Figure 4:
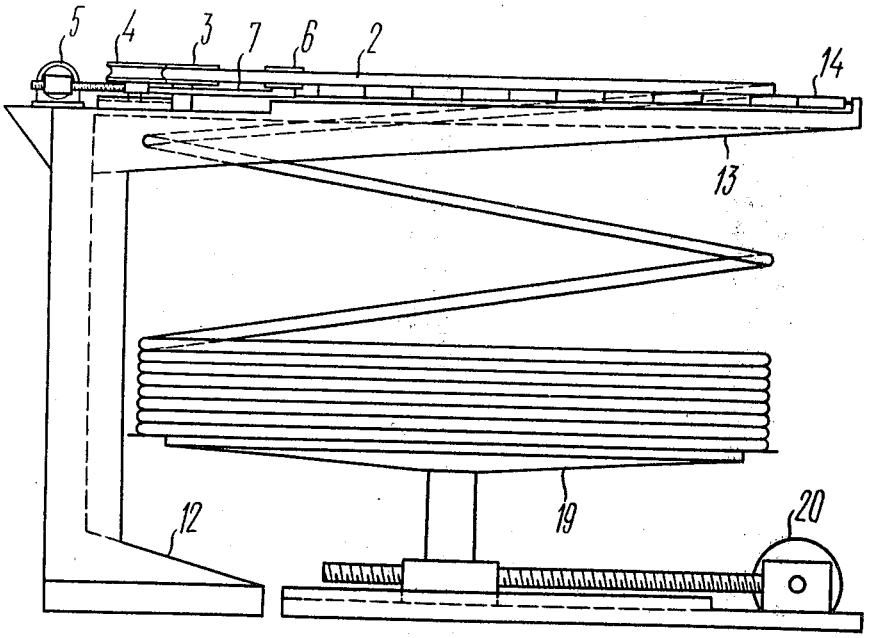
FIG. 4 is a side elevation of the embodiment of FIG. 1.

With reference to FIGS. 1, 2 and 4, the pipe bending machine of the invention comprises unit 1 for feeding pipe 2. A pipe bending unit includes guide rollers 3, bending roller 4 and drive 5 for imparting movement to the bending roller. A system for controlling the diameter of convolution of the pipe 2 comprises a follow-up roller 6 which contacts said pipe after said pipe has been subjected to the action of the bending roller 4 and a two-arm lever 7. One arm of the lever 7 mounts the follow-up roller 6 and the other arm thereof supports a movable contact 8 of the drive 5. The contact 8 is in electrical contact with stationary contacts 9 and 10 (FIGS. 1, 2 and 3) of current-conducting material. The stationary contacts 9 and 10 are separated by a plate 11 of electrically insulating material.

The pipe bending machine further incorporates a guide structure 13 rigidly secured to and overhanging the frame 12 of the pipe bending machine. The guide structure includes idle rollers 14. The frame 12 accommodates a spring 15 for resiliently urging the two-arm lever 7 into the initial position, a restrictor 16 for restricting the movement of said lever, a switch-off sensor 17 for disengaging the drive of the bending roller 4, and a switch-on sensor 18 thereof.

A coil carrier 19 (FIGS. 1 and 4) collects the coil of pipe being bent, and includes a drive 20 controlled by the same contacts 8, 9 and 10 as the drive 5.

For obtaining tightly packed coils of required outer and inner diameters, the construction of the pipe bending machine provides for forced displacement of the movable and stationary contacts 8, 9 and 10 to control the drive 5 of the pipe bending roller 4 and the drive 20 for rotating the coil carrier 19. This is effected either by displacing the movable contact 8 (FIG. 5) along the length of the two-arm lever 7 by using a drive of any known suitable construction, such as a rack-and-gear drive having a rack 21, gear 22 connected with a separate drive 23 and the drive reverse switches 24 and 25, or, alternatively, by displacing the platform carrying the stationary contacts 9 and 10 using a drive of any conventional design, such as shown in FIG. 6, and comprising a screw 26, a nut 27 connected with a separate drive 28, and limit or reverse switches 29 and 30 for reversing the rotation of the drive 28.

The pipe bending machine of the invention operates as follows.

The pipe 2 (FIG. 1) is conveyed at low feed rate through the pipe feed unit 1 and the guide rollers 3 to come into contact with the bending roller 4. During this time, the bending roller 4 and the follow-up roller 6 stay in their initial positions, shown in FIG. 2, while the drive 5 of said bending roller is deenergized. The drive 5 is then energized by the switch-on sensor 18 of any conventional construction, such as, for example, a photoelectric sensor or a limit switch, which is in operative proximity with the leading end of the pipe 2. Since the movable contact 8 is electrically connected to the stationary contact 9 during the energization of the drive 5 (FIG. 2), the bending roller 4 is moved in the left-to-right direction to thereby bend the pipe 2. During such bending the follow-up roller 6 contacts the pipe being bent and moves to the right to pivot around the center of rotation of the two-arm lever 7 which coincides with the longitudinal center line of the pipe 2 to thereby move the movable contact 8 downwards across the stationary contact 9. When the contact 8 has been moved into contact with the insulating plate 11 (FIG. 3), the electrical circuit is broken and the drive 5 is deenergized. The bending roller 4 is then fixed in position, whereby a required diameter is imparted to the coil of pipe being bent.

Thus, the follow-up system maintains the preset value of pipe coil diameter. If a portion of pipe entering the bending unit is less rigid than the portion which has already passed this unit, for example, the diameter of the pipe convolution decreases. This in turn moves the follow-up roller 6 to the right, whereby the lever 7 moves the movable contact 8 into electrical contact with the stationary contact 10. This action energizes the drive 5 to move the bending roller 4 to the left to increase the diameter of the pipe coil until the follow-up roller 6 returns to a preset position and the contact 8 moves upwards until it contacts the insulating plate 11. Thereafter, the drive 5 is deenergized and the bending roller 4 is fixed in required position.

The follow-up system works similarly to correct the coil diameter to a preset value when the bending unit receives a more rigid portion of the pipe to be bent. In such a case, the coil diameter will tend to increase, while the follow-up roller 6 will be moved to the right. As a result, the contacts 8 and 9 will close the drive 5 circuit and the bending roller 4 will start its movement to the right, to reduce the diameter of the pipe coil until its required value is maintained.

In order to set a required diameter of the coil, the movable contact 8 is displaced along the arm length of the lever 7 to a suitable position at which it is fixed or stopped by any known means, such as by a screw.

In order to eliminate damage to the pipe coil surface and prevent the incoming pipe 2 from being twisted, the pipe coil, after passing the bending roller 4, is conveyed along the guide structure 13 to one of the idle rollers 14 and then lowered onto the coil carrier 19. The coil carrier 19 has the general form of a disc capable of axial rotation. When the pipe 2 settles on the coil carrier 19, it rotates said carrier about its own axis which substantially coincides with the central axis of the pipe coil perpendicular to the plane of pipe bending.

To assure that the coils are laid coaxially with the coil carrier 19, when the diameter of the coil varies, said coil carrier is moved accordingly in the direction of movement of the bending roller 4 by the drive 20 and the system of movable and stationary contacts 8, 9 and 10 which energize the drive 20 and reverse it in essentially the heretofore described manner with reference to the drive 5 of the bending roller 4. The diameter of the pipe coil is reduced by moving the bending roller 4 in a left-to-right direction, while the coil carrier 19 is moved toward said bending roller or in a right-to-left direction. Conversely, in order to increase the coil diameter, the bending roller 4 is moved to the left, while the coil carrier 19 is moved to the right.

To obtain a tightly packed coil wound in several rows relative to the plane of bending, the movable and stationary contacts 8, 9 and 10 of the drive 5 are forcibly displaced to impart movement to the bending roller 4 within the limits determined by the inner and outer diameters of the coil. Various arrangements, as described hereinafter, may be utilized to accomplish this.

Figure 5:
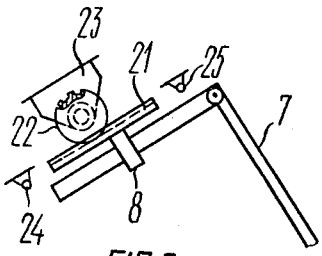
FIG. 5 is a plan view of an embodiment of the two-arm lever of the embodiment of FIG. 1.
Figure 6:
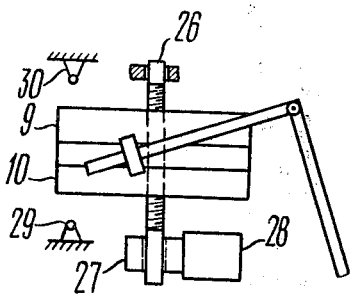
FIG. 6 is a view of another embodiment of the two-arm lever of the embodiment of FIG. 1.

In the embodiment illustrated in FIG. 5, the coil diameter is changed within preset limits by reciprocating the movable contact 8 along the length of the lever 7 using the rack 21 in engagement with the gear 22, said gear being driven by the drive 23. The rack 21 cooperates with the contacts of the reverse switches 24 and 25 which reverse the drive 23 and therefore change the direction of movement of the rack 21 and contact 8. A changed position of the contact 8 on the arm of the lever 7 results in the energization of the drive 5 of the bending roller 4 via the contacts 9 and 10. This results in the moving of the bending roller 4 in the plane of bending to increase or decrease the diameter of the coil.

In the embodiment of FIG. 6, the diameter of the coil convolutions is changed as a result of displacement of the platform carrying the stationary contacts 9 and 10, this displacement being effected by means of the screw 26, the nut 27 and the nut drive 28. The drive 28 is reversed by the reverse switches 29 and 30. While being displaced with the platform, the contacts 9 and 10 alternately make electrical contact with the contact 8 to energize accordingly the drives 5 and 20 which operate synchronously to change the diameter of the coil and move the coil carrier 19 to ensure coaxiality between the coil convolutions and said coil carrier thereby providing variations in the coil diameter within preselected limits.

The switch-off sensor 17 of any conventional design such as, for example, a photoelectric sensor, or limit switch, at the rear end of the pipe 2 entering the pipe feed unit 1 (FIG. 1) disengages the follow-up system, energizes the drive 5 of the bending roller 4 to move it to the initial position (FIG. 2), disengages the drive 20 of the coil carrier 19 and moves the rollers of said pipe feed unit and the rollers 3 of the bending unit to move apart whereby the rear end of the coiled pipe is released and the finished coil may be removed from the coil carrier. Under the action of the spring 15, the lever 7 is also deflected to the left and to assume the initial position, as best seen in FIG. 2.

When the leading end of a subsequent pipe 2 approaches the pipe feed unit 1, the cooperation of said pipe with the sensor 17 causes the rollers of said unit to move toward each other and upon coming into contact with said pipe 2 to feed it to the bending unit. As a result of cooperation of the leading end of the pipe 2 with the sensor 18, the drive 5 of the bending roller 4 is energized and subsequent to the movable contact 8 making contact with the insulating plate 11 the follow-up system and the drive 20 of the coil carrier are engaged. The following operations of the pipe bending machine are similar to those described hereinabove.

The invention is by no means restricted to the aforementioned details which are described only as examples; they may vary within the framework of the invention, as defined in the following claims.

It will thus be seen that the object set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

We claim:

1. A pipe bending machine, comprising pipe feeding means for feeding incoming pipe;

a pipe bending device including a bending roller for bending said pipe drive means coupled to said pipe bending device for displacing said bending roller in a plane of pipe bending;

a two-arm lever having a pivot axis intersecting the center line of said incoming pipe;

a follow-up roller mounted on one arm of said lever and contacting said pipe after said pipe has been subjected to the action of said bending roller;

said drive means having a movable contact mounted on the other arm of said lever for displacing said bending roller, said movable contact being movable about the axis of said other arm and two stationary contacts for displacing said bending roller, said stationary contacts alternately making electrical contact with said movable contact; and a coil carrier for accommodating a coil of bent pipe.

2. A pipe bending machine as claimed in claim 1, wherein said movable contact of said drive means is movable along the length of said other arm.

3. A pipe bending machine as claimed in claim 1, further comprising a platform reciprocable relative to said movable contact within limits determined by inner and outer diameters of the coils of bent pipe and wherein said stationary contacts of said drive means are arranged on said platform.

4. A pipe bending machine as claimed in claim 1, wherein said coil carrier is reciprocable in a plane substantially parallel to said plane of pipe bending towards and away from said bending roller and in synchronism with said bending roller.

5. A pipe bending machine as claimed in claim 2, further comprising means for automatically reciprocating said movable contact along the length of said other arm within limits determined by preselected inner and outer diameters of the coils of bent pipe.

6. A pipe bending machine as claimed in claim 2, wherein said coil carrier is reciprocable in a plane substantially parallel to said plane of pipe bending towards and away from said bending roller and in synchronism therewith.

7. A pipe bending machine as claimed in claim 6, further comprising an overhanging guide structure extending in said plane of pipe bending and having a length at least equal to a maximum diameter of said coil, said guide structure including idle rollers for supporting the convolutions of said coil and free movement thereof towards said coil carrier.

* * * * *